United States Patent [19]

Giguère

[11] Patent Number: 4,510,715

[45] Date of Patent: Apr. 16, 1985

[54] COMPOSITE WEATHER STRIP FOR WINDOWS AND DOORS

[75] Inventor: Jean P. Giguère, St-Agapit, Canada

[73] Assignee: Donat Flamand Inc., Lotbiniere, Canada

[21] Appl. No.: 480,307

[22] Filed: Mar. 30, 1983

[30] Foreign Application Priority Data

Nov. 12, 1982 [CA] Canada ..... 415437
Jan. 12, 1983 [CA] Canada ..... 419291

[51] Int. Cl.[3] ..... E06B 7/16

[52] U.S. Cl. ..... 49/488; 49/489; 49/495

[58] Field of Search ..... 49/488, 489, 495, 475

[56] References Cited

U.S. PATENT DOCUMENTS

| | | | |
|---|---|---|---|
| 2,592,861 | 4/1952 | Close | 49/495 X |
| 3,276,167 | 10/1966 | Bus et al. | 49/489 X |
| 3,378,958 | 4/1968 | Parks et al. | 49/495 X |
| 3,504,456 | 4/1970 | Frederick, Jr. | 49/489 X |
| 3,761,347 | 9/1973 | Yackiw | 49/495 X |
| 4,255,902 | 3/1981 | Ruff | 49/488.1 |

FOREIGN PATENT DOCUMENTS

| | | | |
|---|---|---|---|
| 920991 | 3/1963 | United Kingdom | 49/495 |

*Primary Examiner*—Philip C. Kannan
*Attorney, Agent, or Firm*—Larson & Taylor

[57] ABSTRACT

A weather strip for doors and windows of the casement and awning types, primarily for domestic use, and the like, made of two different thermoplastic materials, one being relatively flexible but having sufficient mechanical rigidity so as to prevent shrinking or stretching of the weather strip when installed, and the other being considerably more supple and flexible. The weather strip has a T-shaped base with anchoring means on the vertical bar of the T-shaped base, and two supple wings made of the more flexible material, extending parallel to one another but spaced apart and secured to the opposite end portions of the horizontal bar of the T-shaped base. This weather strip, which can also take some other forms, particularly in respect of its gripping leg, defines between its supple wings an air space which constitutes an excellent thermal barrier between inside and outside conditions which is particularly useful in cold climates. Moreover, the flexibility of the thin wings ensures easy opening of the door or window so equipped in view of the fact that yielding of the double wing arrangement necessitates very limited opening force. The wings are sufficiently long as to permit proper weather stripping even if the clearance around the hinged panel of the door or window is not perfectly uniform.

9 Claims, 2 Drawing Figures

COMPOSITE WEATHER STRIP FOR WINDOWS AND DOORS

BACKGROUND OF THE INVENTION

Figure 1:
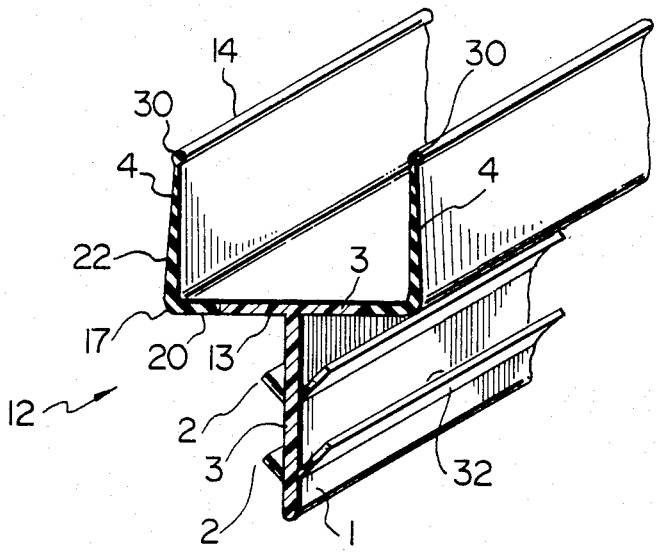

This invention relates to weather stripping for windows and doors, particularly windows of the casement or awning type, principally for domestic use.

The conventional form of weather stripping around casement and awning windows or doors is a thin flexible sheet of copper or aluminum. These foil weather strips are located between the door jamb and the outside peripheral edges of the hinged panel. They are not sufficiently supple to retain their initial position once they have been accidentally bent or used for a prolonged period of time. In addition, they provide no thermal barrier between inside and outside conditions. Furthermore, in view of the fact that only one strip of sheet metal is used, weather proofing is never perfect even in new installations. It is also known to use such thin foil weather strips made of plastic material secured by gluing but these have been found quite fragile and ill-adapted to resist cracking or breaking in cold climates particularly when icing occurs around the periphery of the hinged panel.

More complex weather stripping systems have been developed in recent years which are adapted primarily for use in association with doors and more particularly for use on the threshold of doors as can be found by a review of the following United States patents: U.S. Pat. No. 2,592,861 to Close dated Apr. 15, 1952, U.S. Pat. No. 3,504,456 to Frederick dated Apr. 7, 1970, U.S. Pat. No. 3,521,404 to Hager et al dated July 21, 1970, U.S. Pat. No. 3,672,424 to Brown dated June 27, 1972, U.S. Pat. No. 3,851,420 to Tibbetts dated Dec. 3, 1974, U.S. Pat. No. 3,854,246 to McAllister dated Dec. 17, 1974, U.S. Pat. No. 4,006,562 to Belanger et al dated Feb. 8, 1977, U.S. Pat. No. 4,255,902 to Ruff dated Mar. 17, 1981, U.S. Pat. No. b 4,310,991 to Seely dated Jan. 19, 1982. The sealing elements disclosed in these various patents are relatively complex and designed for use only in association with hinged doors where there is a considerable degree of latitude for adjustment upon installation and subsequently thereto, and wherein the opening force may be quite high and still be tolerable in view of the relatively large extent of the panel being weather proofed. However, these sealing means are hardly convenient for windows of the casement and awning type which is the primary object of the present invention.

A sealing element having certain similarities with the weather strip according to the present invention is disclosed in U.S. Pat. No. 3,276,167 to Bus et al dated Oct. 4, 1966. However, this sealing element, in spite of the fact that it presents two sealing members in strip form is nevertheless fondamentally different from that of the present invention as will become more apparent from the following description.

The primary object of the present invention is to provide an extremely simple weather strip which is convenient for use around the hinged panels of windows of the casement and awning type and which is also usable around door panels and which assures essentially perfect weather proofing coupled with good thermal installation between inside and outside conditions. It is also an object of the present invention to provide such a weather strip which is very easy to install and also to replace should it ever become necessary to do so, and which is cheap to manufacture and convenient to install on the periphery of the hinged panel of a window or door opening.

I have discovered that these objects can be obtained in accordance with this invention with the use of a weather strip made of two different thermoplastic materials one being relatively rigid as to be stable against contraction and stretching, and the other being relatively supple and flexible so as to produce a perfect seal with minimal resistance to opening of the panel from the fully closed position. The weather strip in accordance with this invention comprises a base portion made of the relatively rigid plastic material which base portion presents a horizontal bar, and two spaced apart thin wings supported to the opposite ends of the bar of the base, which wings are made of the more flexible and supple plastic material. The wings project upwardly from the upper surface of the base away from the lower surface of the base which comprises suitable anchoring means.

The wings are sufficiently long and spaced apart so as to define therebetween a volume of air which becomes totally confined when the panel is in the fully closed position. The entrapped air becomes an effective thermal barrier between the inside and the outside conditions. The free edges of the wings are sufficiently fine and flexible as to provide excellent weather proofing even in conditions where the gap around the panel of the window or door opening is not perfectly uniform. Preferably, the composite weather strip according to this invention is produced by co-extrusion of two compatible thermoplastic materials, and the resultant combination has sufficient rigidity and stability as a result of the relatively strong base portion but its wings are very supple whereby they can easily bend and fold when opening the window or door to which they are secured. Preferably, the base of the weather strip is T-shaped and the vertical leg thereof constitutes a gripping leg having suitable anchoring means for holding the weather strip by frictional engagement with a relatively deep groove extending continuously around the window or door panel, which continuous groove extends on the outside edges of such panel. Longitudinal ribs on the gripping leg of the weather strip constitutes a preferred form of anchoring means which has been found quite suitable and reliable.

Figure 2:
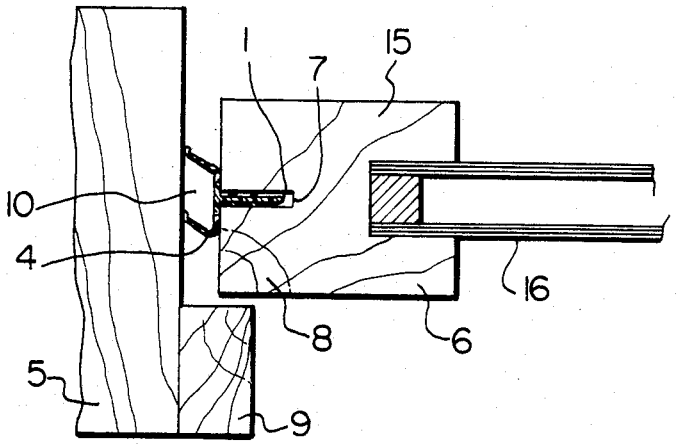

These features and other characteristics of the present invention will become more apparent from the reading of the following detailed description of a preferred embodiment of the invention in association with the accompanying drawings wherein:

FIG. 1 is a vertical cross-section of a weather strip shown in perspective view, and FIG. 2 is a horizontal cross-section of a structure comprising a mobile element and a fixed element, to which structure a weather strip according to this invention is incorporated, which structure is illustrated in the fully closed position.

Weather strip 12 illustrated in FIG. 1 comprises a T-shaped base 3 made of a sufficiently rigid plastic material. To the vertical leg 1 of base 3 are secured four gripping ribs 2 forming a double arrow arrangement. These gripping ribs are preferably made of a rubber like material more supple and more flexible than that of base 3. The horizontal bar of T-shaped base 3 may have, in a preferred embodiment, a length of approximately $\frac{3}{8}$ of an inch. At each end of this horizontal bar, a wing 4 is secured which extends upwardly and parallel to gripping leg 1. Wings 4 are therefore parallel to one another and they extend in the same direction. They are made of a rubber like supple and flexible material and they taper gradually toward their free edge 14. Each wing 4 is preferably constituted of an inner part 20 located in the extension of horizontal bar 13 of T-shaped member 3, of an upper portion 22 which tapers and of an intermediate curved portion 17 interconnecting the inner and the outer portions.

In addition, according to a preferred embodiment of this invention, each wing 4 is provided along its free edge with a small bulge as illustrated at number 30, which bulge facilitates yielding of the wings 4 upon opening of the panel which supports the weather strip. This slight bulge 30 also provides additional strength to wings 4 and this reduces the risk of premature tearing thereof. The free edges 32 of gripping ribs 2, being of considerably lesser importance, presents sharp edges in order to increase resistance to pulling of weather strip 12.

I prefer to use anchoring means for weather strip 12 in the form of anchoring ribs 2 made of a supple material and forming a double arrow arrangement because this means has been found to be extremely simple and effective in practice. However, it should be obvious that other anchoring means can be employed in order to retain the T-shaped base in a suitable receiving groove as will be described hereinafter. One can also envisage the use of anchoring ribs and other forms of anchoring means made of the same plastic material as that of which T-shaped base 3 is fabricated.

FIG. 2 illustrates a structure comprising a fixed element 5 and a mobile element 6 to which is incorporated the weather stip 12 illustrated in FIG. 1. The main axis or leg 1 of the weather strip is deeply anchored into groove 7 made in mobile element 6. In practice, in the case of a casement window, fixed element 5 is the frame of the window opening and mobile element 6 is the hinged sash comprising frame 15 and any glazing, a doubled sealed glazed arrangement being shown in FIG. 2.

When the structure is in the closed position, as illustrated in FIG. 2, the extremity 8 of mobile element 6 bears against stopper 9 of fixed element 5 and, upon movement, wings 4 will bend in one direction or in the other depending upon the displacement of window sash 6. The volume of air confined within space 10 constituted between wings 4 forms an efficient thermal barrier between the outside air and the inside ambient air. The length and the flexibility of wings 4 allows them to adjust themselves to and even compensate for a structure which is not accurately adjusted within the supporting frame.

In addition, upon opening of the hinged panel 6, that is to say when the extremity 8 of mobile element 6 moves away from stoppeer 9 of fixed element 5, the flexibility of supple wings 4 allows them to bend upon themselves before following the motion imparted to them, and the friction thus created does not damage wings 4 and does not offer excessive resistance to opening. On the other hand, gripping leg 1 being made of a more rigid material is efficiently rigid to resist to shearing forces and tensions imposed upon weather strip 12, which forces are in any event quite small.

The height of the outer portion 22 of wings 4 may vary according to the needs in each application, and a height of a quarter of an inch for a spacing of $\frac{3}{8}$ of an inch has been found very satisfactory.

I have discovered that the weather strip according to the present invention is particularly useful when incorporated in a casement window or in an awning window or in a domestic door in households located in cold climates where it is more and more important to reduce heat losses by air infiltration in openings. This weather strip does not require seasonal adjustment upon the arrival of winter time, and its replacement, should it ever become necessary to do so, can be effected easily by the consumer without the use of any particular tool.

In order to construct the weather strip 12 made of two different substances as illustrated in FIG. 1, one may use the well known process called co-extrusion which allows the simultaneous extrusion of two compatible thermoplastic materials which joins these materials within the extruding dye. On the other hand, the method of manufacture of the weather strip 12 does not form part of the present invention which is more particularly concerned with the structure of such weather strip no matter the means used to realize same.

The choice of the materials is relatively important to the success of the weather strip of the present invention although the exact composition of the substances is not critical. The T-shaped base 3 must be made of a plastic material which is sufficiently rigid in order to permit insertion and retention of the weather strip within groove 7 which receives it, and in order to properly support wings 4 and maintain same spaced apart from one another. This plastic material must also prevent as much as possible longitudinal shrinking because otherwise the weather strip would produce voids in the corners. It should also have sufficient flexibility in order to resist cracking especially at low temperature. The polyvinyl chloride (PVC) is an example of an appropriate substance. As for wings 4, a rubber compatible with the plastic material of which the T-shaped base is made must be selected on account of its characteristics at extreme temperatures as may be encountered. The material must remain flexible even at low temperatures of the order of −30° C. and also should have sufficient strength to retain its initial shape even at normal temperatures of from 20° to 30° C. For example, one may use a composite of plasticized PVC and of a synthetic rubber in various proportions to satisfy the temperature conditions such as coefficient of linear stretching, cold resistance, heat resistance and thermal stability, and in order to meet the mechanical requirements for each application, for example, stretching, resistance to traction and hardness. The following table provides, purely for indicative purposes, the technical data of two materials which were used for making a particularly advantageous embodiment of the invention:

| Characteristics | Material for the T-shaped base | Material for wings |
|---|---|---|
| cold resistance | no cracking at −35° C. (24 hrs) | no cracking at −35° C. (24 hrs) |
| heat resistance | no deformation at 70° C. (24 hrs) | no deformation at 70° C. (24 hrs) |
| thermal stability | 125 minutes (DIN 53381, 180° C.) | 118 minutes (DIN 53381, 180° C.) |
| coefficient of linear stretching | $0{,}082 \times 10^{-3}$/°C. (VDE 0304 par. 4, part 1) | $0{,}084 \times 10^{-3}$/°C. (VDE 0304 par. 4 part 1) |
| density | 1,306 g/cm$^3$ (DIN 53479) | 1,146 g/cm$^3$ (DIN 53479) |
| hardness (±3°) | 98° shore A | 60° shore A |
| resistance to traction | 220 N/mm$^2$ (DIN 53504) | 110 N/mm$^2$ (DIN 53504) |
| stretching to rupture | 250% (DIN 53504) | 420% (DIN 53504) |

-continued

| Characteristics | Material for the T-shaped base | Material for wings |
|---|---|---|
| permanent deformation following storage in hot air under pressure | n.d. | maximum 13% (DIN 53517/1971, 24 hrs, 70° C. constant load 5 bar/cm$^2$) |

I claim:

1. Weather strip for use on the periphery of the hinged panel of a window or door opening being of constant cross-section and comprising a T-shaped base made of relatively rigid plastic material, said T-shaped base having a horizontal bar and a depending vertical gripping leg, said horizontal bar carrying along each edge thereof and functionally integral therewith a generally vertical wing which extends outwardly, laterally from the base and then curves upwardly away from said base, in a direction opposite from said gripping leg, said two wings being generally parallel to each other and spaced by a distance of the order of $\frac{3}{8}$ of an inch, said wings being made of a rubber-like plastic material which is more supple and flexible than the material of said T-shaped base, whereby said wings may bend easily when said hinged panel closes or opens and yet when said panel is in its fully closed position said wings confine a volume of air which constitutes an efficient barrier between inside and outside conditions, said wings being sufficiently supple as to regain their initial shape upon opening of said hinged panel and having sufficient resistance to cracking and tearing in spite of frequent panel opening and closing operations, said gripping leg having gripping means for holding said weather strip to the periphery of said panel by means of a continuous groove in the peripheral edges of said hinged panel.

2. Weather strip as defined in claim 1 wherein said gripping means comprises anchoring ribs extending longitudinally on either side of said gripping leg, and wherein said wings taper toward their respective free edges which are rounded.

3. Weather strip for domestic door and window of the casement or awning type comprising a T-shaped base of rigid material having a horizontal bar and an integral gripping leg perpendicular to said bar extending centrally along the lower surface of said bar; said weather strip also having two thin and supple weather sealing wings made of a rubber-like material which is more flexible and rubber-like than the material of the base, said wings being secured to said bar, along each edge of said bar, each wing having an inner portion consisting of a short lateral extension of said bar of the same thickness and functionally integrally butt joined to said bar; an outer portion tapering toward its free edge and an intermediate curved portion tapering interconnecting said inner and outer portions, said outer portion of each wing extending upwardly relative to the upper surface of said bar, the outer portion of said wings being essentially parallel to each other and to said gripping leg and spaced apart from each other so as to define therebetween an air space which constitutes a thermal barrier when said weather strip is in place on a door or window which is in its fully closed position with the outer portions of the wings engaging a mating surface.

4. Weather strip as defined in claim 3 wherein the distance separating said two wings is of the order of $\frac{3}{8}$ of an inch and wherein the height of the outer portion of each wing is of the order of $\frac{1}{4}$ of an inch.

5. Weather strip as defined in claim 3 wherein the free edge of each wing comprises a slight rounded bulge for facilitating yielding of each wing upon opening of said door or window, and wherein said gripping leg comprises a series of inclined longitudinal ribs forming a double arrow pointing away from said bar.

6. An extruded composite weather strip made of plastic material, comprising a rigid flat strip-like base portion made of plastic material and two sealing wings made of a more flexible and rubber-like material than that of the base portion and functionally integral with the base portion, the materials of said base portion and of said sealing wings being compatible with each other, said sealing wings extending outwardly laterally from said base portion and then curving upwardly away from the upper surface of said base portion as two generally parallel thin sealing elements to form with said strip-like base portion a U-shaped channel, said sealing elements tapering gradually toward their respective free edges for added compliance with mating surfaces, said base portion being made of a plastic material which is sufficiently rigid to properly hold and guide said sealing wings and prevent shrinking or stretching of said weather strip when in place on the periphery of a door or window.

7. An extruded composite weather strip according to claim 6, said base portion being T-shaped, the stem of the T forming an anchoring means.

8. An extruded composite weather strip according to claim 7, said wings and said base portion each being of a thermoplastic material, said anchoring means comprising a main portion of said rigid material and a series of inclined ribs forming a double arrow pointing away from said bar.

9. In a casement type door or window of the type comprising a hingedly movable sash panel, containing a glazed arrangement and movable to a closed position in which its edge faces a fixed structural element, and forms a space between the panel and the fixed structural element, an improved sealing for said space, comprising:

an extruded compsite weather strip made of plastic material and comprising a rigid flat strip-like base portion made of plastic material and two sealing wings made of a more flexible and rubber-like material than that of the base portion and functionally integral with the base portion, the materials of said base portion and of said sealing wings being compatible with each other, said base portion including an anchoring means on its lower surface for anchoring it into a groove formed along the periphery of the sash panel, with the rigid flat strip-like base portion positioned against the periphery of the sash panel on opposite sides of the groove, said sealing wings extending outwardly laterally from said base portion and then curving upwardly away from the upper surface of said base portion as two generally parallel thin sealing elements to form with said strip-like base portion a U-shaped channel, said sealing elements tapering gradually toward their respective free edges for added compliance with mating surfaces so as to define in the space formed by the sealing wings and the mating surface of the fixed structural element an air space which constitutes a thermal barrier, said base portion being made of a plastic material which is sufficiently rigid to properly hold and guide said sealing wings and prevent shrinkage or stretching of said weather strip.

* * * * *